United States Patent [19]

Pryke et al.

[11] 4,190,383

[45] Feb. 26, 1980

[54] STRUCTURAL ELEMENT

[75] Inventors: John F. S. Pryke, Broxbourne; David S. Pryke, Brent Pelham, both of England

[73] Assignee: Pynford Limited, London, England

[21] Appl. No.: 868,529

[22] Filed: Jan. 11, 1978

[30] Foreign Application Priority Data

| | | | |
|---|---|---|---|
| Jan. 13, 1977 | [GB] | United Kingdom | 1354/77 |
| Jan. 24, 1977 | [GB] | United Kingdom | 2711/77 |
| Mar. 9, 1977 | [GB] | United Kingdom | 9866/77 |

[51] Int. Cl.[2] ..... E02D 5/10

[52] U.S. Cl. ..... 405/252

[58] Field of Search ..... 61/53, 53.5, 63; 405/231, 232, 250, 251, 252, 253, 256

[56] References Cited

U.S. PATENT DOCUMENTS

| | | | |
|---|---|---|---|
| Re. 17,367 | 7/1929 | Pierce | 280/84 |
| 956,126 | 4/1910 | Merrill | 405/240 |
| 975,487 | 11/1910 | Welsh | 405/245 |
| 1,342,424 | 6/1920 | Cotten | 405/253 |
| 1,654,644 | 1/1928 | Goldsborough | 405/246 |
| 1,769,774 | 7/1930 | Denise et al. | 175/52 |
| 1,887,630 | 11/1932 | Frankignoul | 405/242 |
| 1,997,312 | 4/1935 | Satre | 405/240 |
| 2,342,243 | 2/1944 | Brizay | 61/53.5 |
| 2,684,576 | 7/1954 | Pickman | 405/237 |
| 2,797,466 | 7/1957 | Lidberg | 61/53 X |
| 3,131,543 | 5/1964 | Dougherty | 61/53.5 |
| 3,263,431 | 8/1966 | Phares | 61/53.5 |
| 3,316,723 | 5/1967 | Schutte | 405/223 |
| 3,326,006 | 6/1967 | Mount | 61/53 |
| 3,422,630 | 1/1969 | Marier | 61/53.5 X |

*Primary Examiner*—Dennis L. Taylor

*Attorney, Agent, or Firm*—Martin P. Hoffman

[57] ABSTRACT

The invention is concerned with a method of driving a columnar pile into the ground. The pile is formed by a number of load-bearing segments each of which contributes only a part of the area of contact between the surface of the pile and the surrounding earth. The load-bearing segments at any time forming that part of the pile in the ground are advanced in turn a little way into the ground and the cycle is repeated over and over again until the pile is in its fully driven position.

12 Claims, 7 Drawing Figures

STRUCTURAL ELEMENT

The invention is concerned with the driving of columnar friction piles end first into the ground.

PRIOR ART

In the driving of such piles, it is known to provide the pile in the form of a number of separate segments which are assembled end to end to form the pile. The leading segment is first thrust into the ground whereafter successive segments are successively fitted to the end of the previously driven segment or segments and in turn driven into the ground pushing the previous segments in front. Although this has the advantage that the whole length of the pile does not have to be handled and supported when its leading end is first thrust into the ground, the reaction required becomes greater as more and more segments are fitted and pushed into the ground, owing primarily to the frictional resistance between the sides of the segments in the ground and the surrounding earth. During the driving operation, the frictional resistance steadily increases and large heavy structures are required to develop the necessary driving reaction. For example, in the case of a pile which is put down adjacent to a building to provide a new foundation for underpinning the building, the reaction necessary to thrust the pile down into the ground during the latter part of the driving operation may be three or four times the maximum safe load bearing capacity which the pile will eventually provide. Since this maximum driving reaction on the pile may be some six times as great as the dead weight of the part of the building to be supported by that pile, it is clearly impossible to develop the necessary driving reaction by taking an abutment from the part of building, unless piles are jacked in in groups, which is unpracticable and uneconomic under light buildings such as houses. An alternative is to use heavy machinery or large quantities of kentledge mass of heavy weights and this is both laborious and expensive.

It is also known to provide a thin casing for a cast in situ pile in the form of a number of telescopic segments. The telescopically retracted segments are first pushed into the ground to the depth of the outer segment, whereafter the inner telescopic segments are successively extended into the ground from within the outer segment. Although this has the advantage that at any time the driving reaction only has to overcome the frictional resistance between the periphery of one of the casing segments and surrounding earth, it is an expensive technique involving smooth telescopic sliding between a number of accurately nested segments and in practice it is only useful for cast in situ piles and not for piles which are built up from preformed segments.

SUMMARY OF THE INVENTION

In accordance with the present invention, in a method of providing a columnar pile in the ground, the pile is formed by a number of segments each of which contributes only a part of the area of contact between the surface of the pile and the surrounding earth, and the segments at any time forming that part of the pile in the ground are advanced in turn a little way into the ground and the cycle is repeated until the pile is in its fully driven position.

With this arrangement it is only necessary to provide the maximum reaction required for advancing through the ground a single segment. As the force required to drive one segment will usually increase with depth, it may be possible to drive two or more segments simultaneously at shallower depths during the initial stages in the pile driving sequence of operation. The necessary reaction may readily be developed by simple jacking devices, from a comparatively small and lightweight abutment adjacent to ground level, or possibly via a group of segments in the ground, which are not at that moment being driven, from their frictional resistance with the ground.

The driven segments are preferably arranged to form a hollow pile body which is subsequently filled with cement or resin grout, if necessary after reinforcement has been inserted, to interconnect the segments rigidly together. The pile may also be prestressed if a prestressing wire is anchored to a segment at the leading end, that is the foot, of the pile.

The pile may have any of a possible wide range of external cross sectional shapes, ranging from a simple circle, to a star or cruciform shape. The use of a non-circular external cross section not only enables differential bending resistance to be produced in different directions, but maximizes the peripheral area of frictional contact between the friction pile and the surrounding earth, for a given volume and cross sectional area of the pile. When the pile is to support an offset load, for example when put down adjacent to an underpinning beam, the cross section is preferably elongate in a direction perpendicular to the length of the beam.

The pile may be divided longitudinally into a number of side by side segments each providing a fraction of the circumference of the pile. Thus if the cross section of the pile is circular or annular, the segments will be sector-shaped.

When the pile is divided longitudinally, it may be necessary to provide some means for keying or holding together adjacent segments so that they may slide longitudinally relatively to one another without splaying apart. Mating keying formations may be formed in the adjacent surfaces of adjacent segments or a keying member, for example of dumbell shape, may bridge between undercut grooves in the adjacent segment surfaces. Alternatively, the segments may be surrounded by a retaining band or bands. To reduce sliding friction between the non-external surfaces of the segments and the adjacent surfaces of adjacent segments, one or both of the contacting surfaces may be coated with a low friction material such as PTFE.

Preferably, however, the pile is divided transversely to its length into a number of abutting segments arranged end to end, each contributing only a part of the length of the pile. It might be possible to divide the pile both longitudinally and transversely but this is more complex.

When the segments are arranged end to end along the pile, the segments above the leading segment will preferably be tubular and the segments are repeatedly driven a little way into the ground in cycles beginning from the leading segment at the bottom of the pile and working successively up the pile by means of driving means extending down through the tubular segments. Each cycle will advance the whole pile by the small amount by which each segment is moved and in a typical case, say, 100 cycles would be required to drive the pile fully to the working depth.

The driving means may be a reciprocating driving member which is repeatedly brought into driving engagment with successive segments. Thus the driving member may be a mandrel which is operated from above ground level and which incorporates a ratchet mechanism for repeated engagement with successive segments. Alternatively, the driving member may be a chuck which is driven up and down a guide rod extending down through the segments, the chuck being expandible into engagement with successive segments in turn.

Preferably, however, the driving means presently considered most suitable for driving 5 or 6 m. deep piles for use in underpinning houses on stiff shrinkable clays comprises a central driving member surrounded by a number of concentric tubular driving members, the lower ends of successive ones of the driving members in the radial outward direction abutting against respective successive ones of the pile segments in the direction from the bottom of the pile upwards. The driving members are repeatedly advanced a little way downwards working successively radially outwardly from the central driving member. The concentric tubular driving members can themselves be made in axial segments which are added to as the pile is advanced into the ground. The driving members may be advanced successively down the pile by means of a common driving head incorporating a number of reaction members which successively act on individual cross heads connected to the upper ends of respective ones of the driving members. Alternatively the concentric driving members may have at their upper ends angularly offset axial projections and the driving head may have a radial bar which is reciprocated axially and rotated through a small angle between each working stroke so that by engagement of the bar with successive projections the members are successively driven downwards in a driving cycle. Yet a further driving means for the concentric tubes might involve a nesting set of hydraulic rams.

It is not necessary for the leading segment, and successive segments, to be advanced at each stage by a distance equal to the axial length of the segment and the segments may be advanced at each stage by a matter of only a few mm. This minimises the gap which appears between a segment being advanced at any time and the succeeding segment and hence reduces the danger of spoil entering the gap and interfering with the subsequent end to end abutting engagement of the adjacent segments when the succeeding segment is subsequently advanced. This danger may be eliminated entirely by providing each segment with a trailing skirt into which the nose of the succeeding segment fits. The segments will then only be advanced by a distance no greater than the overlap between a complementary skirt and nose. Alternatively it may be sufficient if the nose of each segment is chamfered to provide a sharp taper for pushing radially outwardly again any spoil tending to move into the gap.

If the pile is of constant cross section, the reaction required to drive the leading segment will normally be greater then that required to drive the succeeding segments, because the advancement of the leading segment has to displace soil necessary to accommodate the cross section of the element. This end reaction, which will usually increase as the leading segment of the element is forced further into the ground, may be at least twenty times as large per unit area of bearing surface than the frictional reaction between the side of the segment and the surrounding earth. This problem can be met in a number of ways. For example the leading segment might be subjected to a vibration, for example by a pair of side by side vibratory hammers. Alternatively, the leading segment may be formed around its periphery with a cutting shoe, the spoil cut out being withdrawn to ground level through for example a rotating auger extending up a tube through the pile from the cutting tube to ground level or above. Yet again the leading segment may be formed itself into a number of side by side sections, for example a central and one or more sections alongside or surrounding the central section, which can be successively driven into the ground. The reaction required to drive any one section of the leading segment into the ground may then be comparable with that required to drive any other segment into the ground. Also, in order to reduce the friction required to drive the leading segment into the ground, and also to assist in guiding the leading segment along a straight line. A pilot hole, smaller than the cross section of the pile, may be prebored at least partway into the ground. Furthermore, the leading segment and/or successive segments may have an appreciable taper towards its leading tip.

If the external cross section of the pile is increased either gradually or in stepwise fashion from the leading segment to the upper end of the pile, the pile may be designed such that substantially the same reaction is required to drive each segment into the ground. This minimizes the cross section of the leading segment which experiences the greatest resistance to its being advanced into the ground; ensures that the upper segments of the pile are in firm frictional contact with the ground through which the preceeding segments have already passed; and thus provides for the most efficient driving machine by utilising the full capacity of every segment and minimises the number of segments for a given reaction to working load ratio.

If the upper soil strata are unstable, an upper portion of the pile may be surrounded by a fluent, resilient or crushable material to isolate the top of the pile against a reaction resulting from horizontal movement of the surrounding earth. This may involve making one or more segments at the upper portion of the pile smaller in plan area than that of the uppermost load bearing segment.

The segments may be of any appropriate load bearing material. Thus the leading segment may be made of steel or reinforced concrete and the succeeding segments may be made for example of fibre and/or metal reinforced concrete. When the pile segments are made of precast concrete, each segment may have a cast-in reinforcing member against which the respective driving member engages, thereby protecting the concrete against the liability to crumble under extreme local pressure. The reinforcing member may itself be connected with metal reinforcement embedded within the concrete segment.

DESCRIPTION OF THE DRAWINGS

The use of piles constructed in accordance with the invention for use in supporting an underpinning beam of a building, is illustrated by way of example in the accompanying drawings, in which.

BRIEF DESCRIPTION OF THE INVENTION

Figure 1:
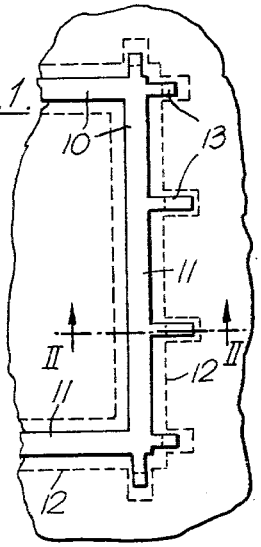
FIG. 1 is a diagrammatic plan of the building.
Figure 2:
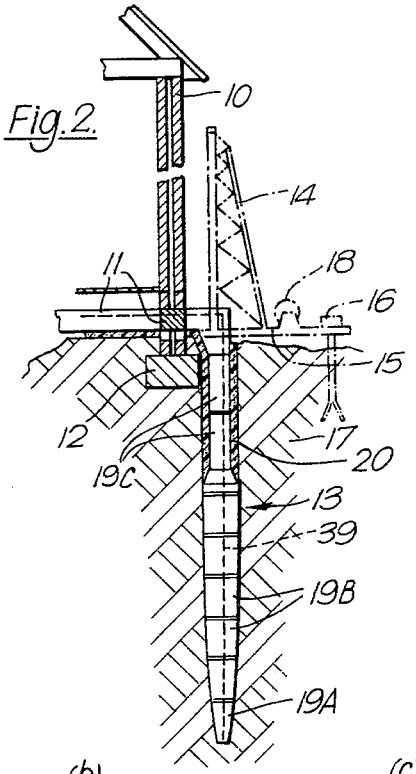
FIG. 2 is a diagrammatic section taken on the line II—II in FIG. 1.

FIGS. 1 and 2 show the walls 10 of a building which is underpinned. A beam 11 is provided in the plane of each wall 10 adjacent to the bottom of the wall. The beam is constructed by cutting a horizontal slot along and through the wall, pinning the wall above up at intervals by means of stools, inserting reinforcement, and casting as in situ beam encapsulating the reinforcement and stools.

The old foundations for the walls 10 are shown at 12.

The weight of the building is carried through the beams 11 down to new foundations provided by piles 13 of square or rectangular section.

Each pile may be put down utilizing a support structure 14 which is erected on a stiff horizontal member 15 one end of which is located beneath the Pynford beam 11 and the other end is held down to the ground by means of a ground anchor 16. The support 14 acts as a guide for the pile segments before they are pushed down into the ground 17, as a suport for a driving head for the pile segments, and for transmitting the driving reaction to the pile segments from a winch 18.

Figure 3:
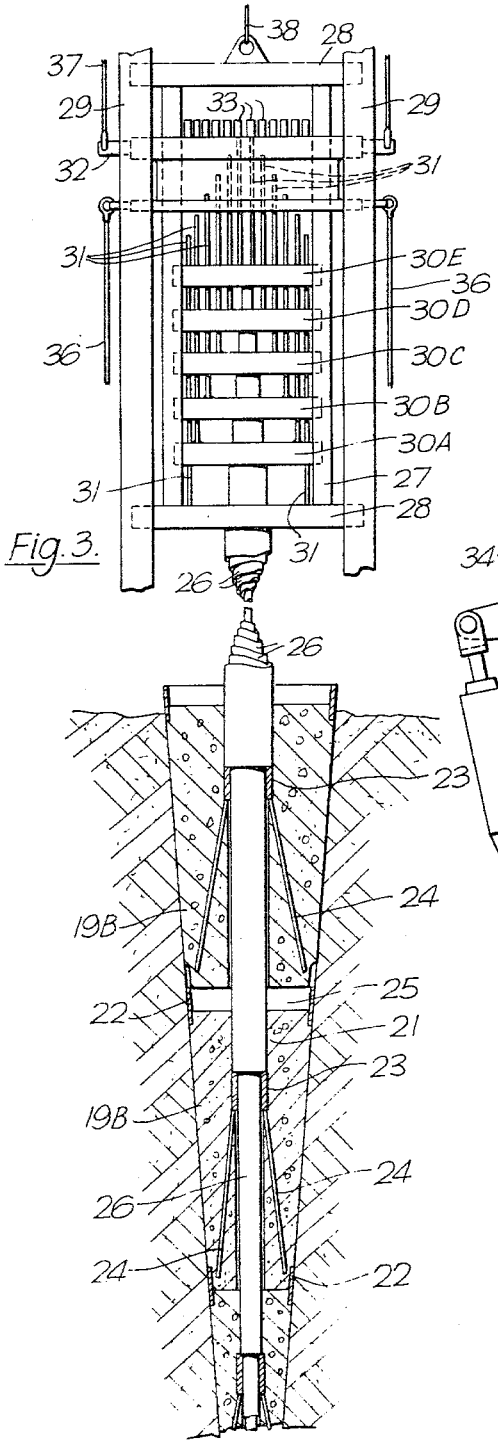
FIG. 3 is a diagrammatic axial sectional view showing the drawing of one pile.

As shown in FIGS. 2 and 3, the pile is made up from a number of segments 19A, 19B and 19C. In FIG. 2 for simplicity of illustration, the pile segments 19 are shown with a smaller length to width ratio than they would have in practice and the segments 19B shown in FIG. 3 are more realistically proportioned. However, as shown in FIG. 2, the segments taper towards the bottom of the pile. The segments 19C at the tip of the pile are narrower than the segments 19B and are surrounded by a crushable material 20, such as expanded polystyrene, which also extends under the beam 11, to isolate the building from possibly unstable upper strata of earth which might move.

The leading segments 19A may be a precast concrete element, or a steel element.

As shown particularly in FIG. 3, each segment 19B is a tubular precast concrete element having a central passageway 21. The diameter of the central passageway of each segment is approximately 15 mm. less in diameter than that of the segment above. At its trailing end each segment has integrally cast a trailing skirt 22 which receives the nose of the segment above. Internally each segment has a cast-in steel ring 23 the upper edge of which projects as an abutment shoulder into the passageway 21, for use in driving the segment. Each ring 23 is also rigid with a ring of splayed reinforcing legs 24 which are useful for spreading the load into the segment.

The segments 19C are constructed similarly to the segments 19B except that their external cross section is reduced to accommodate the material 20.

In a typical underpinning pile of the kind illustrated, for use in clay soil, it is envisaged that the pile might be up to 5 m. long, and there would be up to 10 segments each up to 500 mm. long. The width or breadth of the leading segment 19A of a pile of square or rectangular cross section might be about 75 mm., and the width and breadth of the widest segment 19B of a pile of rectangular cross section might be of the order of 250 mm. and 400 mm. respectively.

Before putting down the pile, a narrower pilot hole may be drilled partway into the ground. First of all the segment 19A is pushed a little way into the ground, and the first segment 19B is pushed after it until it abuts the first segment. The leading segment 19A is then advanced a few say 50 mm. further into the ground and the second segment is closed up behind it again. This is repeated until there is room for the second segment 19B to be inserted into the ground and the three segments then in the ground are repeatedly advanced little by little. The cycle is repeated until all the segments are in the ground. Each segment is only advanced by an amount to close up the gap between itself and the proceeding segment and to open up a gap ahead of the succeeding segment. Such a gap 25 is illustrated in FIG. 3 and it will be seen that this gap is less than the length of the trailing skirt 22 so that the gap is always shielded from the surrounding soil.

Figure 4:
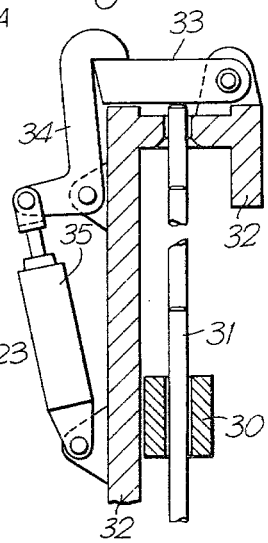
FIG. 4 is a sectional detail showing part of the driving head of FIG. 3.

A suitable means for driving the segments successively and repetitively into the ground is illustrated in FIGS. 3 and 4. The driving means comprises a number of concentric steel tubes 26, with a wall thickness of about 6 mm., which slide closely within one another and within the tubular passageways 21. The lower end of each tube 26 abuts against a respective one of the rings 23. The tubes 26 may themselves be formed in a number of end to end segments which abut against one another, the junctions between adjacent segments in adjacent tubes being axially offset from one another. The upper ends of the tubes 26 are connected to a pile head 27 having upper and lower members 28 which are vertically slidable in channels 29 forming part of the support 14. The sides of the head 27 themselves form guides for a series of cross heads 30 which are in vertical alignment and are movable upwards and downwards relatively to one another. The upper end of the largest one of the tubes 26 is connected to the lower member 28. The next smaller diameter tube 26 passes through the member 28 and is connected to the lowest cross head 30A. The tube 26 with the next smallest diameter passes up through the lower member 28, the cross head 30A, and is connected to the cross head 30B, and so on. The lower member 28 and each of the cross heads 30 has extending upwards from it a pair of sliding rods 31. These rods slide through holes in all the cross heads 30 above and terminate adjacent to a driving head 32. This driving head 32 is also slidable in the channels 29 and incorporates a number of horizontal bars 33, one for each rod 31. Each of the bars 33 is pivotally mounted on the driving head 32 and can be held in its horizontal position by a respective pawl 34 operated by a fluid cylinder 35.

Figure 5:
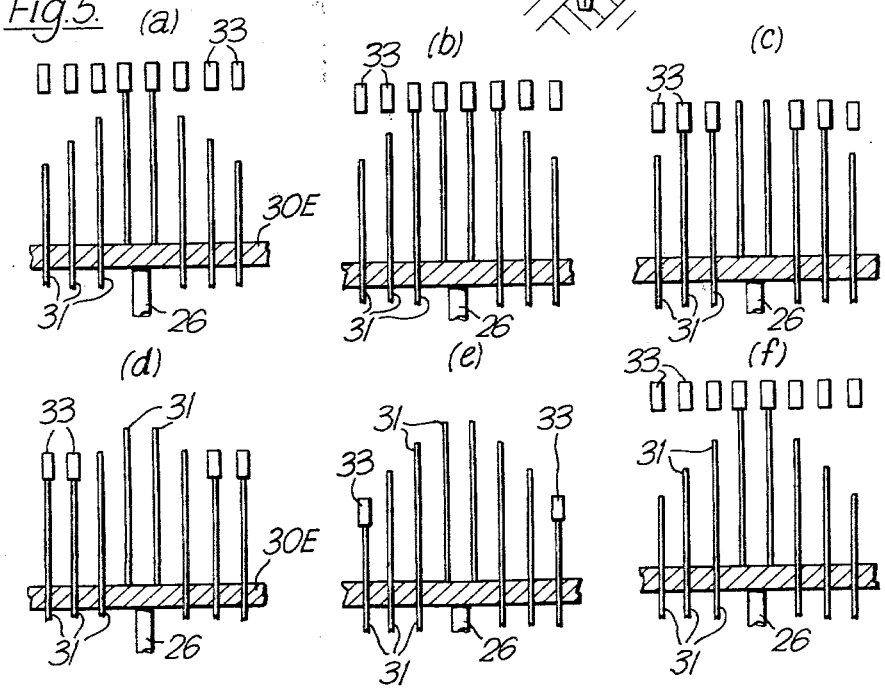
FIG. 5 is a diagram showing successive stages in driving the pile of FIG. 3.

At the beginning of a driving cycle, the rods 31 are staggered as shown in FIG. 3 and FIG. 5*a*. The central tube 26 has to be forced downwards first and this is achieved by operating the winch 18 so that, through cables 36 the driving head 32 is pulled downwards and the two central bars 33 force the two central rods 31, and hence the top cross head 30E downwards by about 50 mm. This movement is transmitted through the central rod to the leading pile segment 19A. The cylinders 35 for the two central bars 33 are then operated to release the bars so that they can swing upwards. The winch 18 is again operated to pull the driving head down through a further distance so that the next two bars 33 engage the next two rods 31 and force the cross head 30D and the corresponding tube 26 downwards to advance the first segment 19B downwards again by about 50 mm. This is repeated as shown in sequence in FIG. 5 whereafter the driving head 32 is raised again by means of cables 37 connected to another winch and the bars 33 relatched in their driving positions. The cycle is then repeated over and over again.

When a new segment or sections of the tube are to be inserted, the pile head 27 is raised by operation of a further winch acting through a cable 38.

When the pile has been fully driven into the ground, the pile head is removed together with the tubes 26. Reinforcement 39 is inserted down the hollow core of the pile formed by the passageways 21, and the core is grounted up, the pile core being united with the beams 10 in conventional fashion. As suggested in FIG. 2, the reinforcement 39 in the pile core is offset from the centre of the pile to compensate for the offset load.

The illustrated pile with the above mentioned dimensions, can be driven in by a reaction of three or four tons, which is readily available using a simple hydraulic jack taking its reaction from the underpinning beam 11. The resulting pile can provide a safe load of up to 10 tons.

Figure 6:
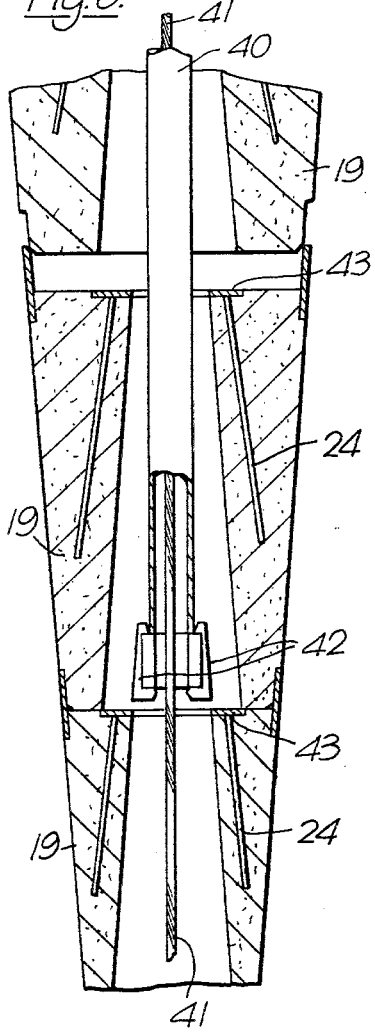
FIG. 6 is a sectional diagram showing the driving of another pile.

FIG. 6 shows a modification of FIG. 3 in which the segments 19 are driven by a reciprocating mandrel 40 which is guided on a rod 41 and carries an expanding chuck 42. The inner surfaces of the segments 19 taper in the upwards directon frusto-conically to provide their inner upper edges with a shoulder reinforced by a steel ring 43. The rod 41 at all times extends down to the bottom segment 19A and the mandrel 40 and chuck 42 are controlled from above ground level. When a segment is to be pushed down, the chuck 42 is expanded immediately above the corresponding shoulder 43 and the mandrel 40 is then driven down by a short distance. The chuck 42 is contracted and raised prior to expansion above the shoulder of the segment above and the driving of that segment.

The FIG. 6 technique could be modified by causing the chuck 42 to be expanded into internal gripping engagement with a segment 19 to be driven, rather than into a position overlying the reinforced shoulder 43.

Figure 7:
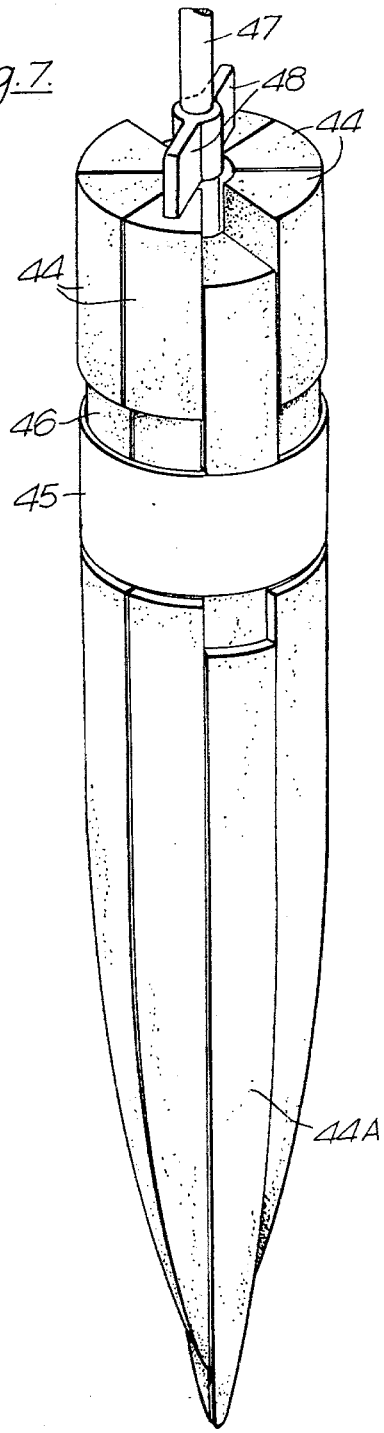
FIG. 7 is a perspective diagram illustrating the driving of a further pile.

FIG. 7 shows an alternative pile which is divided by axial planes into a ring of annular sector shaped segments 44 which extend the full length of the pile. The segments 44 are shown held together by an encircling band 45 which is seated in complementary grooves 46 in the outer surfaces of the segments 44. The segments 44 are driven into the ground successively in diametrically opposed pairs by means of a reciprocating mandrel 47 carrying a pair of wings 48 which engage the tops of a pair of the segments. Thus a pair of the segments are driven a few millimeters into the ground, to an extent allowed by the cooperation of the band 45 and grooves 46, whereafter the mandrel 47 is raised, turned through a small angle to bring the wings 48 into engagement with the next pair of segments 44, and the mandrel is driven down once again. FIG. 7 shows one segment 44A which has been advanced relatively to the adjacent segments.

We claim:

1. A method of driving a columnar load-bearing pile into the ground, said pile comprising a leading segment for penetrating the ground and a plurality of load-bearing segments, the leading segment having a leading edge and a trailing edge with a body extending therebetween, the cross-sectional area of the leading segment being smaller than the cross-sectional area of each load-bearing segment, each load-bearing segment having a leading edge, a trailing edge and a body extending therebetween, said method comprising the steps of:

(a) forcing the leading segment into the ground so that its entire axial length is tightly engaged therewith, (b) forcing the leading edge of the first load-bearing segments into the ground until it abuts against the trailing edge of the leading segment, (c) advancing the leading segment further into the ground an axial distance corresponding to a small fraction of its length to form a gap between the leading segment and the first load-bearing segment, (d) advancing the first load-bearing segment further into the ground until the gap is closed and the leading edge of the first load-bearing segment abuts against the trailing edge of the leading segment, (e) repeating steps (c) and (d) several times, and in the stated sequence, until the leading segment and the first load-bearing segment have been forced completely into the ground in tight frictional engagement along their axial lengths, (f) forcing the leading edge of the second load-bearing segment into the ground until it abuts against the trailing edge of the first load-bearing segment, and (g) repeating steps (c), (d) and (f) several times, and in the stated sequence, so that gaps between the adjacent segments are alternately formed and closed until the leading segment and the plurality of load-bearing segments have all been forced completely into the ground in tight frictional engagement along their axial lengths.

2. The method of driving a columnar, load-bearing pile into the ground, as set forth in claim 1 further including the step of drilling a pilot hole prior to forcing the leading segment of the column into the ground.

3. The method of driving a columnar, load-bearing pile into the ground as set forth in claim 1 wherein the magnitude of the forces driving the leading segment and the load-bearing segments is considerably less than the load-bearing capacity of the pile, when completed.

4. The method of driving a columnar, load-bearing pile into the ground as set forth in claim 1 and further including the step of positioning a skirt between each adjacent load bearing segment, said skirt preventing the surrounding soil from entering the gap temporarily formed between adjacent load bearing segments.

5. The method of driving a columnar, load-bearing pile into the ground as set forth in claim 1, wherein said leading segment and said load-bearing segments are tubular in shape, and said method further includes the steps of inserting driving means into the interior of the segments, and repeatedly raising and lowering said driving means for applying driving forces to said load-bearing segments in succession, starting with the leading segment and working progressively upwardly through the load bearing segments.

6. The method of driving a columnar, load-bearing pile into the ground as set forth in claim 5 further including the step of securing a steel reinforcing ring within each load-bearing segment for cooperation with said driving means.

7. The method of driving a columnar, load-bearing pile into the ground as set forth in claim 5 further including the step of filling the interior of each load-bearing segment with grout to rigidly join said segments together.

8. A method of driving a columnar load-bearing pile into the ground, said pile comprising a leading segment for penetrating the ground and a plurality of load-bearing segments, the leading segment having a leading edge, a trailing edge, and a body extending therebetween, each load-bearing segment having a leading edge, a trailing edge, and a body extending therebetween, said method comprising the steps of:

(a) forcing the leading segment into the ground so that its entire axial length is tightly engaged therewith, (b) forcing the leading edge of the first load-bearing segment into the ground until it abuts against the trailing edge of the leading segment, (c) advancing the leading segment further into the ground an axial distance corresponding to a small fraction of its length to form a gap between the leading segment and the first load-bearing segment, (d) advancing the first load-bearing segment further into the ground until the gap is closed and the leading edge of the first load-bearing segment abuts against the trailing edge of the leading segment, (e) repeating steps (c) and (d) several times, and in the stated sequence, until the leading segment and the first load-bearing segment have been forced completely into the ground in tight frictional engagement along their axial lengths, (f) forcing the leading edge of the second load-bearing segment into the ground until it abuts against the trailing edge of the first load-bearing segment, and (g) repeating steps (c), (d) and (f) several times, and in the stated sequence, so that gaps between the adjacent segments are alternately formed and closed until the leading segment and the plurality of load-bearing segments have all been forced completely into the ground in tight, continuous frictional engagement therewith along their axial lengths.

9. The method of driving a columnar, load-bearing pile into the ground as set forth in claim 8 wherein the load-bearing segments are made of concrete, and each load-bearing segment has a tapered body extending between its leading edge and its trailing edge.

10. The method of driving a columnar load-bearing pile into the ground as set forth in claim 8 wherein the cross-sectional area of the leading segment is smaller than the cross-sectional area of each load-bearing segment, and wherein the cross-sectional area of the first load-bearing segment is smaller than the cross-sectional area of the second load-bearing segment.

11. A method of driving a columnar, load-bearing pile into the ground, said pile comprising a plurality of axially extending arcuate segments, the upper end of each segment having a groove formed therein, a band encircling the arcuate segments and resting within the groove, each segment having a leading edge, a trailing edge, and a body extending therebetween, said method comprising the steps of:

(a) advancing the first arcuate segment into the ground an axial distance determined by the relative movement of the band within the groove and corresponding to a small fraction of the length of the segment, (b) advancing the arcuate segment diametrically opposed to the first segment into the ground an axial distance determined by the relative movement of the band within the groove and corresponding to a small fraction of the length of the segment, (c) advancing the arcuate segment adjacent to the first arcuate segment into the ground an axial distance determined by the relative movement of the band within the groove and corresponding to a small fraction of the length of the segment, (d) advancing the arcuate segment diametrically opposed to the second segment into the ground an axial distance determined by the relative movement of the band within the groove and corresponding to a small fraction of the length of the segment, (e) repeating steps (a)-(d) several times, and in the stated sequence, until all of the arcuate segments have been driven into the ground an axial distance corresponding to a small fraction of the length, and then (f) repeating steps (a)-(e) several times, and in the stated sequence, until all of the arcuate segments have been forced completely into the ground in tight frictional engagement along their axial lengths.

12. The method of driving a columnar, load-bearing pile into the ground as set forth in claim 11, wherein a reciprocating mandrel with a pair of wings is used to simultaneously perform steps (a) and (b), and then, after rotation through a small angle, is used to simultaneously perform steps (c) and (d).

* * * * *